US005162726A

United States Patent [19]

Swanson et al.

[11] Patent Number: 5,162,726

[45] Date of Patent: Nov. 10, 1992

[54] MOLDED ELECTRICAL APPARATUS

[75] Inventors: Roy T. Swanson, LaGrange Park; Henry W. Scherer, Mt. Prospect; Glenn R. Borchardt, Franklin Park, all of Ill.

[73] Assignee: S&C Electric Company, Chicago, Ill.

[21] Appl. No.: 581,489

[22] Filed: Sep. 12, 1990

[51] Int. Cl.[5] ..... H01F 27/00; H01F 27/02

[52] U.S. Cl. ..... 324/127; 264/272.13; 336/96

[58] Field of Search ..... 324/176, 127; 336/96, 336/174, 175; 264/272.13-272.15, 272.18, 272.19

[56] References Cited

U.S. PATENT DOCUMENTS

| | | | |
|---|---|---|---|
| 3,187,282 | 6/1965 | Pierce et al. | 324/126 |
| 3,386,059 | 5/1968 | Stein, Jr. et al. | 324/127 |
| 4,002,976 | 1/1977 | Zulaski . | |
| 4,019,167 | 4/1977 | Barker | 336/96 |
| 4,024,483 | 5/1977 | Tomczak et al. | 336/96 |
| 4,075,273 | 2/1978 | Liautaud | 264/272.19 |
| 4,082,916 | 4/1978 | Jaklic, Jr. et al. | 336/96 |
| 4,171,863 | 10/1979 | Perkins, Jr. | 336/96 |
| 4,289,722 | 9/1981 | Tranbarger | 264/272.13 |
| 4,451,305 | 5/1984 | Neuroth et al. | 264/272.15 |
| 4,510,477 | 5/1985 | Rostron et al. | 336/174 |
| 4,775,849 | 10/1988 | Lucas | 336/90 |
| 4,794,327 | 12/1988 | Fernandes | 324/126 |
| 4,808,910 | 2/1989 | Kessi . | |

*Primary Examiner*—Ernest F. Karlsen
*Assistant Examiner*—William J. Burns
*Attorney, Agent, or Firm*—James V. Lapacek

[57] ABSTRACT

A support arrangement is provided for an electrical device that is embedded within a support body or housing. The support arrangement responds to volumetric changes in the material of the support body during the molding of the support body. In a specific arrangement, the support arrangement accurately positions the electrical device with respect to the exterior of the support body and includes provisions for yieldingly supporting the electrical device.

31 Claims, 5 Drawing Sheets

MOLDED ELECTRICAL APPARATUS

BACKGROUND OF THE INVENTION

1. Field of the Invention

The present invention relates generally to electrical devices such as sensors and transducers and more particularly to a support arrangement for accurately positioning an electrical device that is molded within a support body; the support arrangement responding to volumetric changes in the material of the support body during molding.

2. Description of the Related Art

Various electrical devices molded within support bodies or housings are known, including current and/or voltage transducers incorporated within porcelain structures or molded within housings. For example, see the Fisher Pierce Series 13000 VIP Sensor[198] and the following U.S. Pat. Nos.: 4,823,022; 4,002,976; 4,775,849; 3,315,147; 4,808,910; 4,700,123; 4,019,167; 3,386,059; 3,187,282; 3,970,932; 3,251,104; and 3,932,810. The arrangements of U.S. Pat. Nos. 4,808,910, 4,700,123, 3,315,147, and 4,775,849 dispose an electrical device within a support housing, but do not encapsulate or pot the electrical device. In U.S. Pat. No. 4,019,167, a transformer is encapsulated within a molded jacket. Connector elements for the transformer leads are incorporated with the jacket. Additionally, a cushion of resilient material (closed-cell foam rubber) surrounds the transformer and is co-extensive with the interior of the jacket. U.S. Pat. Nos. 3,932,810, 4,823,022, and 3,187,282 disclose encapsulated transformers or coils, but do not disclose how the transformers or coils are supported during encapsulation. The arrangements of U.S. Pat. Nos. 3,251,014, 3,386,059, and 3,970,932 are directed to the potting of electrical devices such as coils within an annular channel or cavity of a housing or support insulator. In U.S. Pat. No. 3,386,059, the arrangement also provides for the support of a coil assembly by a tube through which conductors from the coil assembly are routed to the base of the insulator.

While these prior art arrangements may be generally useful, they do not provide an arrangement suitable for the molding of an electrical device within a support body that accurately positions the electrical device during molding and that accommodates for the volumetric changes of the molding compound during molding and curing. For example, where the electrical device is located adjacent the top of a support insulator and is supported with respect to the base of the insulator, it is especially important to provide accurate positioning of the electrical device along with compensation for the volumetric changes of the molding compound and the resultant forces on the electrical device and the supporting arrangement therefor. Further, the molding operations are additionally complicated if the electrical device to be encapsulated includes a centrally defined bore through which a conductor is to be disposed so as to be insulated by the molding material from the electrical device. Additionally, other than by deformation of a cushioning element, the prior art arrangements do not address the encapsulation of an object where the shape factor (volume and overall length) and/or surface characteristics are such that during molding and/or curing, volumetric changes of the molding compound relative to the object produce undesirable stresses. For example, U.S. Pat. No. 4,019,167 provides for some relief of undesirable stresses only via a surrounding layer.

SUMMARY OF THE INVENTION

Accordingly, it is a principal object of the present invention to provide method and apparatus for incorporating an electrical device within a support housing wherein the apparatus is simply fabricated through the provision of a support member that accommodates volumetric changes of the housing material during fabrication and that also provides a conduit for electrical leads from the electrical device to a point on the exterior of the housing.

It is another object of the present invention to provide a sensing device incorporated within a molded housing and a support arrangement that accurately positions the sensing device and that responds to shrinkage forces and effects that occur during curing of the molded housing.

It is a further object of the present invention to provide method and apparatus for encapsulating an object within a support body where the shape factor of the object (volume and overall length) is such that volumetric changes during fabrication of the encapsulating material relative to the object produces undesirable stresses.

These and other objects of the present invention are efficiently achieved by the provision of a support arrangement for an electrical device that is embedded within a support body or housing wherein the support arrangement responds to volumetric changes in the material of the support body during the molding of the support body. In a specific arrangement, the support arrangement accurately positions the electrical device with respect to the exterior of the support body and includes provisions for yieldingly supporting the electrical device.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 2:
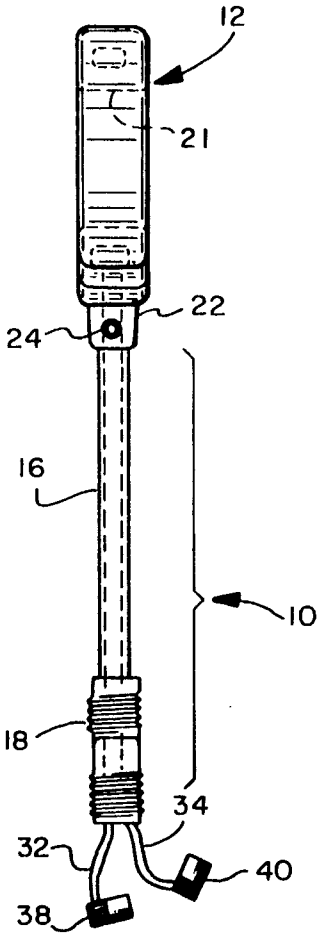
FIGS. 1 and 2 are respective front and side elevational views of the support arrangement of a first embodiment of the present invention illustrated as supporting an electrical device, specifically an electrical parameter sensing device (FIG. 1 being partly in section)
Figure 1:
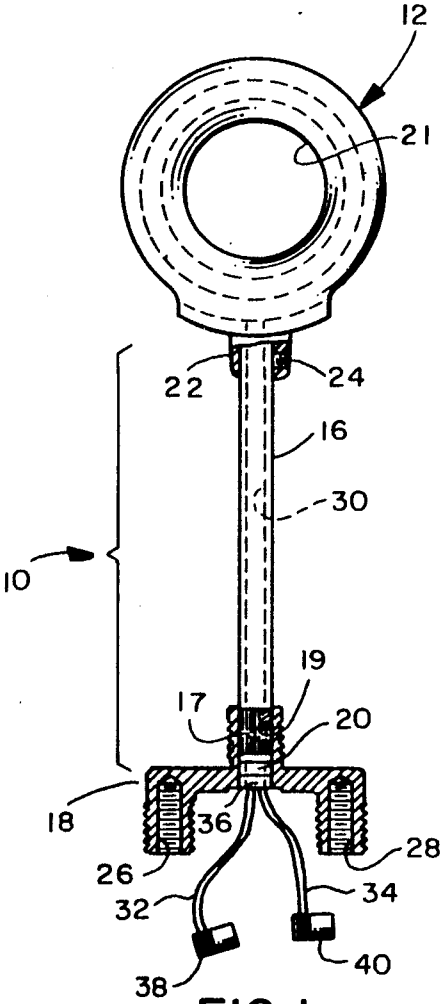

Referring now to FIGS. 1 and 2, the support arrangement 10 of the present invention is shown supporting an illustrative electrical device 12, which in the specific illustration is a current-sensing transformer. The support arrangement 10 includes provisions for accurately positioning and yieldingly supporting the electrical device 12 within a support body. For example, referring to FIGS. 3 and 4, the support arrangement 10 and the electrical device 12 are embedded within, i.e. surrounded by, a support body generally referred to at 14; the overall apparatus 15 having the illustrative volumetric shape for specific application as an insulator and current sensor for an electrical power distribution switch or the like. Preferably, the support body 14 is formed in a molding operation from an electrically insulating material such as cast epoxy resin. As is known to those skilled in the art, it is common and advantageous to use an elevated temperature-curing polymeric compound such as cycloaliphatic epoxy resin to mold the support body. Since the polymeric compound has a different coefficient of expansion versus temperature compared to the electrical device 12 and the support arrangement 10, as the polymeric compound of the support body 14 cools and cures, shrinkage forces are exerted on the electrical device 12 and the support arrangement 10.

Thus, the present invention provides an overall combination of a support arrangement 10 and an electrical device 12 that accommodates the volumetric changes of the polymeric compound so as to compensate for the coefficient of expansion of the molding compound. Accordingly, undesirable effects are avoided during the fabrication of the overall apparatus 15 including the support arrangement 10 and the electrical device 12 within a support body 14. Additionally, in the case of a current-sensing transformer 12, it is preferable to provide an outer compressible layer such as with a closed-cell foam material or the like.

Figure 6:
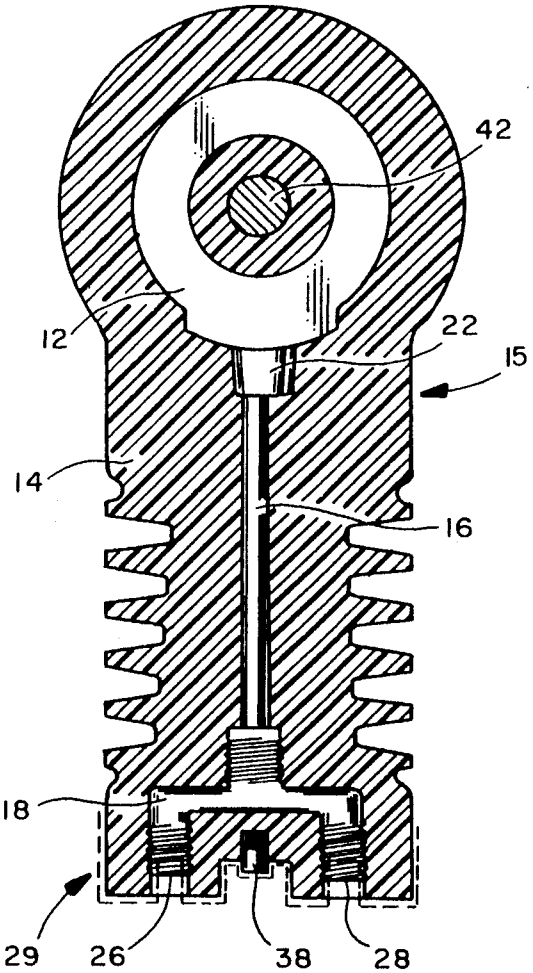
FIG. 6 is a sectional view taken along the line 6—6 of FIG. 5.
Figure 7:
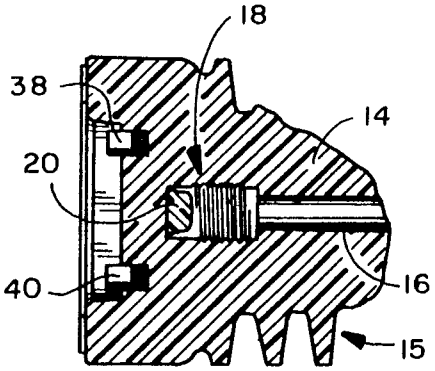
FIG. 7 is a partial sectional view taken along the line 7—7 of FIG. 5.

Referring now additionally to FIGS. 6 and 7, and also with specific reference to FIGS. 1 and 2, the support arrangement 10 in accordance with a first embodiment includes a support tube 16 which is carried at the lower end by a support base 18 via a bore 19 defined in the support base 18. The outside diameter of the bottom end of the support tube 16 along with the bore 19 are dimensioned to provide a predetermined interference fit; e.g., on the order of several thousandths of an inch. The support tube 16 is inserted into the support base 18 to the extent as shown in FIG. 1. In the specific illustrative embodiment, the support tube 16 includes a lower knurled portion 17. Of course, it should be understood that in other embodiments, arrangements such as a split end or spiral pin tube may be utilized to provide the interference fit.

One or more compression members 20 are provided at the bottom of the bore 19. The compression member 20 functions to provide a volumetric space for movement of the support tube 16 downward within the bore 19 in response to forces exerted on the overall electrical device 12 and the support arrangement 10. While the compression member 20 may not necessarily be required, it is believed to be highly desirable to ensure that the polymeric compound will not block or inhibit movement of the support tube 16 during curing. Thus, the support arrangement 10 ensures that undesirable forces will not be exerted on the lower portion of the support body 14 or throughout other portions of the support body 14.

The electrical device 12 is affixed at the top end of the support tube 16 via a yoke of the electrical device 12 having a collar 22 and a set screw or the like 24. The support base 18 in the illustrative arrangement of FIGS. 1 and 2 includes sleeves 26,28 having internal threads. The sleeves 26,28 are utilized for mounting of the apparatus 15 to a mounting base or the like via fasteners (not shown). The support base 18 is positioned during molding as generally referred to at 29, which depicts the partial outline of a mold cavity.

During molding and curing, any shrinkage forces exerted on the overall electrical device 12 and the support arrangement 10 results in movement of the support tube 16 farther into the bore 19 in accordance with desired force versus displacement characteristics. Thus, movement of the support tube 16 into the bore 19 is responsive to the applied forces to relieve any stresses that might result from the volumetric changes of the polymeric compound during curing thereof. In the preferred arrangement, a mold release agent is applied to the exterior of the support tube 16 so as to permit movement of the support tube 16 with respect to the surrounding polymeric compound during curing. A lubricant is applied to the knurled portion 17.

Figure 5:
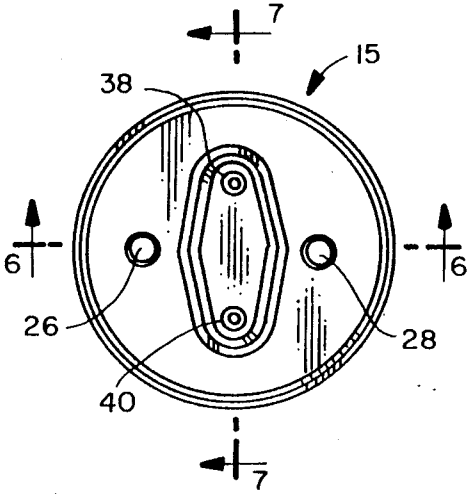
FIG. 5 is a bottom plan view of the apparatus of FIG. 3.

It is desirable to have electrical leads routed through the apparatus 15 to provide electrical connections and signal paths from the electrical device 12 to the exterior of the overall apparatus 15. To this end and specifically referring to FIGS. 1 and 2, the support tube 16 provides a conduit 30 for passage of electrical conductors 32,34 which also pass through the bore 19 and through the center of the compression member 20 via a passageway 36; the compression member being toroidal in shape. In a specific arrangement, the electrical conductors 32,34 carry respective terminal inserts 38,40. As shown in FIGS. 5 through 7, the terminals 38,40 are oriented at the bottom of the support body 14 so as to provide external connection to the terminals 38,40.

In a preferred embodiment, the support tube 16 is either fabricated from conductive material or otherwise fabricated to define a conductive path so as to provide a ground-path for shielding of the electrical device 12 and the electrical conductors 32,34. Additionally, the support base 18 is also conductive or includes a defined conductive path so as to provide a complete electrical ground-path from the electrical device 12 to the threaded inserts 26,28.

Figure 3:
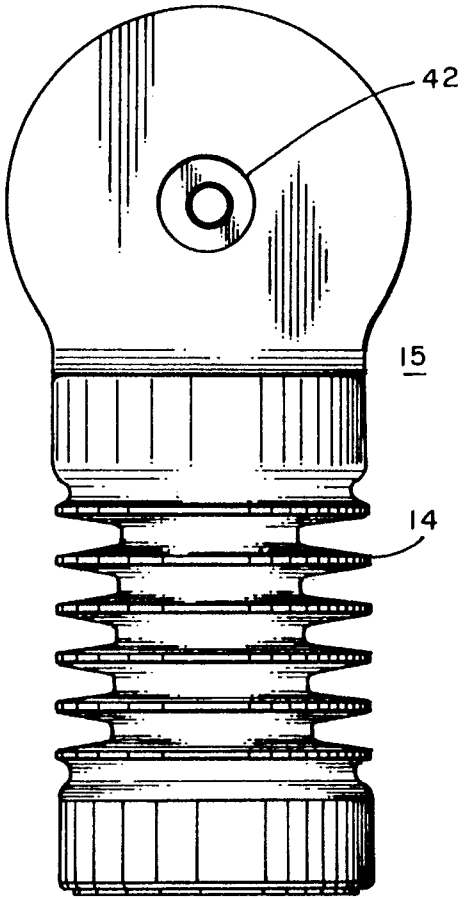
FIGS. 3 and 4 are respective front and side elevational views of apparatus fabricated in accordance with the present invention and utilizing the support arrangement of FIGS. 1 and 2.
Figure 4:
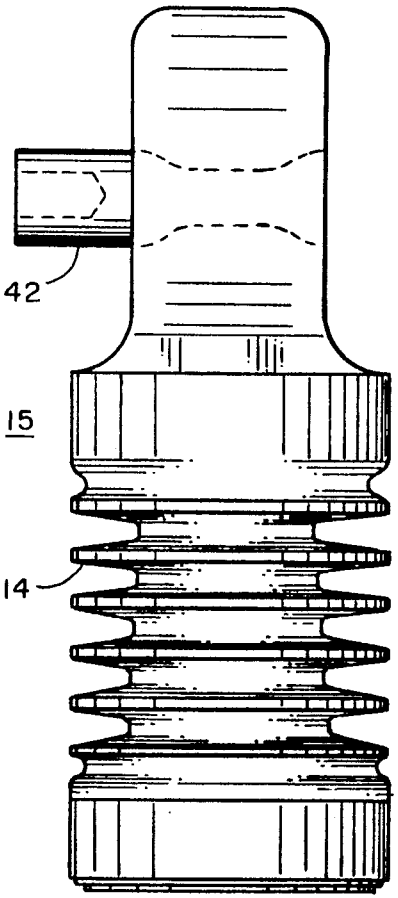

In the specific embodiment depicted in FIGS. 1–7, the electrical device 12 includes a central opening 21. As indicated in FIGS. 3, 4 and 6, a terminal conductor 42 extends through the central opening 21 of the electrical device 12 and is insulated therefrom by the support body 14. Preferably, the terminal conductor 42 is incorporated during the molding process. As can be seen in FIG. 6, the electrical device 12 must be accurately positioned within the support body 14 so as to maintain the proper relationship to the terminal conductor 42.

Figure 14:
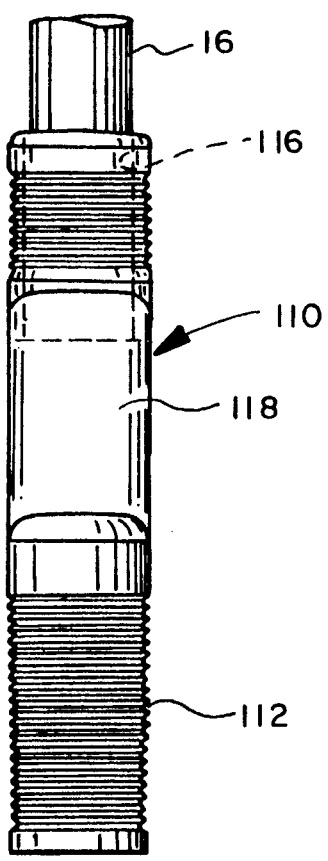
FIGS. 13 and 14 are respective front and left-side elevational views of an alternative support arrangement of the present invention.
Figure 13:
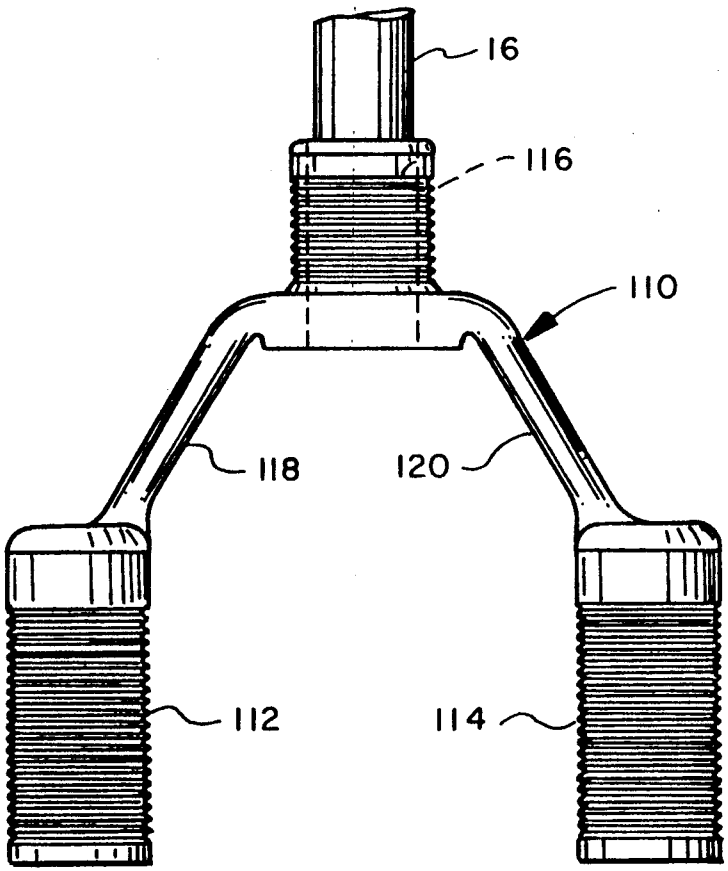

Referring now to FIGS. 13 and 14, an alternate support base 110 is useful in lieu of the support base 18. The support base 110 in one arrangement includes provisions for accurately positioning and yieldingly supporting a device such as the electrical device 12 within a support body. In this regard, it should be noted that the support base 110 can be used in addition to or in lieu of the support tube 16 being moveable within the bore 116 of the support base 110; i.e., the support tube 16 can be movable within the bore 116 as discussed hereinbefore or the support tube 16 can be immovable with respect to the bore 116 and the support base 110 in response to shrinkage forces. The support base 110 includes structural features 118, 120 which provide sufficiently rigid characteristics to accurately position and support the support tube 16 and attached device with respect to the feet or sleeves 112, 114, but flexible enough to yield in response to shrinkage forces within the support body. Thus, in the illustrative embodiment of FIG. 13, the structural features 118, 120 are arms that flex or deform under predetermined applied forces. For example, if the tube 16 is sufficiently immovable within the bore 116 such that forces due to shrinkage are imparted to the support base 110, the arms 118, 120 can be fabricated so as to be flexible enough to yield sufficiently in response to the shrinkage forces, thus relieving any stresses that might result from the volumetric changes of the polymeric compound during curing, etc.

In another arrangement, the support tube 16 is arranged to move within the bore 116 so that no forces or only a portion of the forces are transmitted to the support body 110. Even assuming that no forces are transmitted to the support base 110 via the support tube 16, for support bodies that desirably include portions of the support base 110 that are more widely spaced than that of the support base 18, the flexibility of the arms 118, 120 is useful to avoid deleterious effects due to shrinkage forces on the support base 110. Of course, it should be realized that the flexibility of the arms 118, 120 is selected to have different yield characteristics in response to applied forces for different applications as determined not only by the shape factor, surface characteristics, and expanse of the support base 110, but also as to whether the arms 118, 120 are to yield to forces imparted via the support tube 16 or are to yield only in response to forces directly on the support base 110.

Referring now additionally to FIGS. 8–11, another illustrative embodiment is shown in the configuration of an apparatus 50 including both a voltage sensor and a current sensor. Specifically, the apparatus includes a current-sensing transformer 52 and a support arrangement 53. Incorporated within the support arrangement 53 is a transformer assembly 54 which forms a portion of a voltage sensor of the apparatus 50.

The support arrangement 53 also includes a support tube 56 and a support base 58. An intermediate support 60 is affixed at the top of the transformer assembly 54. The intermediate support 60 includes a bore 62 which receives the support tube 56. The transformer assembly 54 is affixed atop the support base 58. Compression members 20 are provided in the bore 62 adjacent the support tube 56. The upper end of the support tube 56 is affixed to the current-sensing transformer 52.

The overall combination of the support arrangement 53 and the current-sensing transformer 52 are imbedded or encapsulated within a support body generally referred to at 66. Similarly to the embodiment of FIGS. 1–7, the support arrangement 53 yieldingly supports the current-sensing transformer 52 so as to permit relative movement therebetween in response to forces exerted on the current-sensing transformer 52 and the support arrangement 53 during the fabrication of the apparatus 50. Similarly to the support base 18 of the apparatus 15 of FIGS. 1–7, the support base 58 includes sleeves 68, 70.

Figure 9:
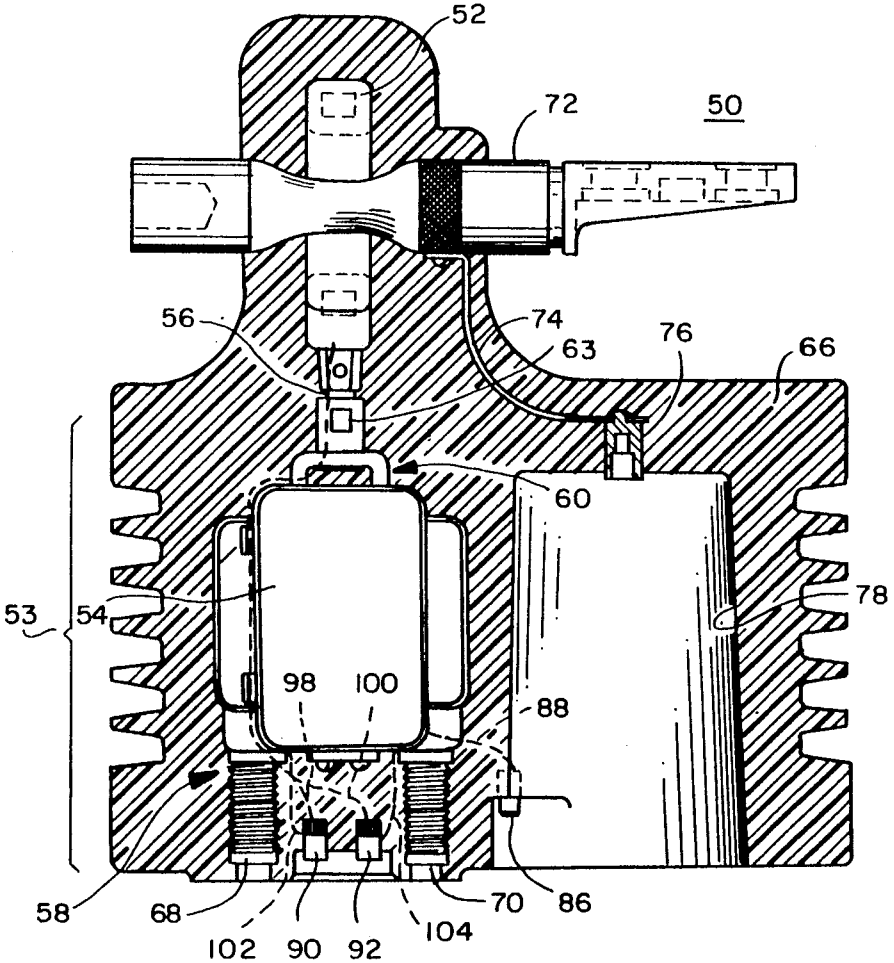
FIG. 9 is a rear view in section of the apparatus of FIG. 8 depicting an earlier stage of fabrication.
Figure 8:
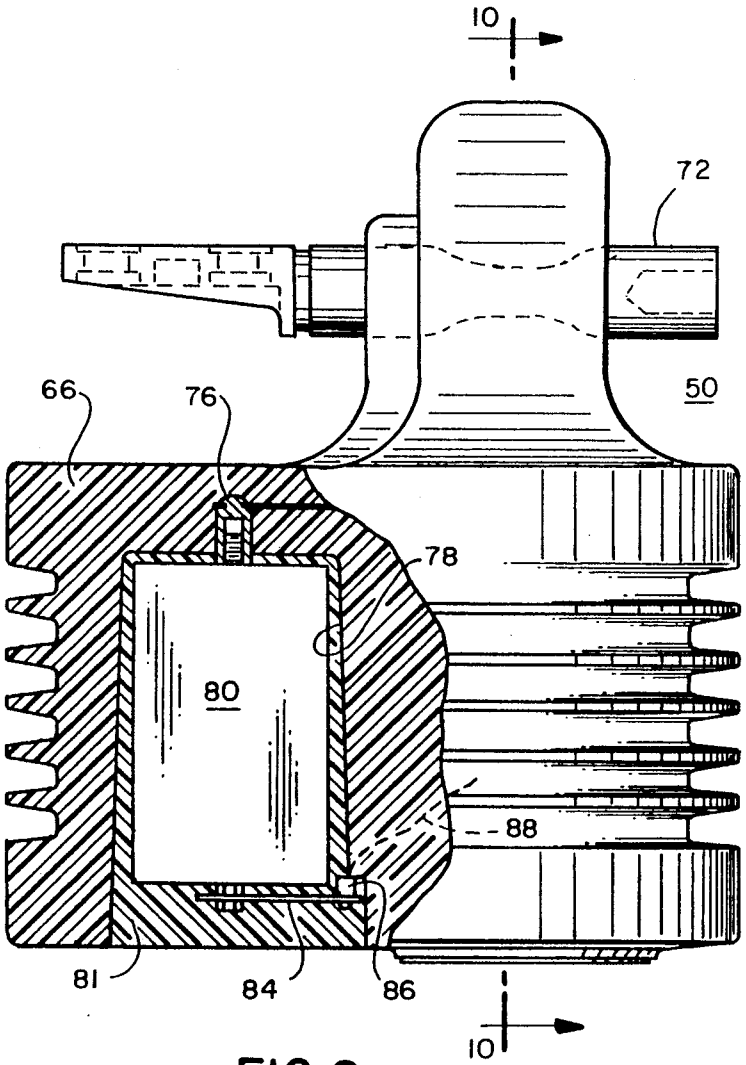
FIG. 8 is a front elevational view, partly in section of a second embodiment of the present invention.

A conductor 72 extends through the center of the current-sensing transformer 52. As shown in FIG. 9, a capacitor conductor 74 is connected between the terminal conductor 72 and a terminal socket 76. The terminal socket 76 during fabrication of the apparatus 50 is positioned so as to communicate with a receiving cavity 78, also defined during the fabrication of the support body 66 of the apparatus 50. After molding of the support body 66, a capacitor 80 is inserted into the receiving cavity 78 and includes a contact 82 that is inserted into the terminal socket 76. The capacitor 80 is supported via an affixed bus 84 that is in turn affixed to and electrically connected to a terminal and bushing arrangement 86. The cavity 78 is then filled with a suitable potting compound 81 to encapsulate the capacitor 80. Preferably, the potting compound 81 is a lower-temperature curing polymeric compound than the material from which the support body 66 is formed. In this manner, the capacitor 80 need not be subjected to the high temperature and shrinkage forces experienced by the electrical device 52 and the support arrangement 53. The terminal and bushing arrangement 86 is connected to a primary winding (not shown) of the transformer assembly 54 via a conductor 88.

Figure 11:
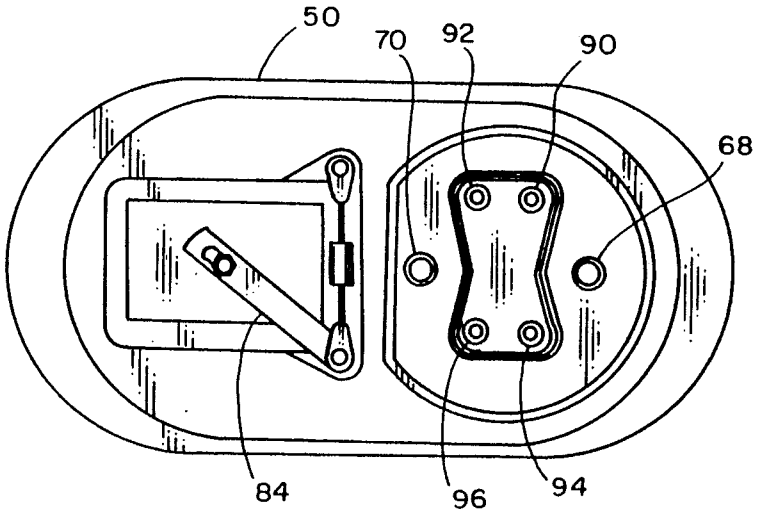
FIG. 11 is a bottom elevational view of FIG. 8 depicting an earlier stage of fabrication.

Terminals 90, 92, 94 and 96 are shown in FIG. 11 (90, 92 are depicted in FIG. 9) for providing output signals of the apparatus 50. Specifically, the terminals 90 and 92 are connected via respective conductors 98, 100 to provide current-sensing output signals; the conductors 98, 100 being connected to the current-sensing transformer 52 and passing through a central conduit 63 of the support tube 62. Similarly, the terminals 94 and 96 provide voltage-sensing output signals from a secondary winding (not shown) of the transformer assembly 54 via respective conductors 102, 104. Preferably, the support tube 56 and the support base 58 are conductive, as is the housing of the transformer assembly 54. Thus, a ground-path is established for the current-sensing transformer 52 via the support arrangement 53, as well as a ground-path connection to the insert sleeves 68, 70.

Accordingly, the apparatus 15 in a particular application functions as an insulator with an integrally incorporated current sensor and the apparatus 50 functions as an insulator with integrally incorporated current and voltage sensors, each for an electrical power distribution switch or the like as set forth in copending U.S. application Ser. Nos. 07/331,311 in the names of T. J. Tobin, et al, 07/331,574 in the names of R. T. Swanson, et al, and 07/331,570 in the names of H. W. Scherer, et al, all filed on Mar. 30, 1989. Reference may also be made to U.S. Pat. No. 4,002,976 for additional discussion of the electrical parameters and consideration of a voltage sensor including a transformer and a capacitor encapsulated therein.

Figure 12:
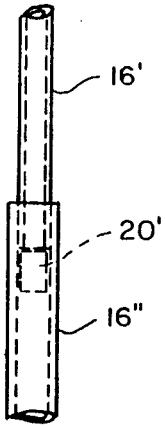
FIG. 12 is an elevational view of another alternate embodiment of the present invention.
Figure 10:
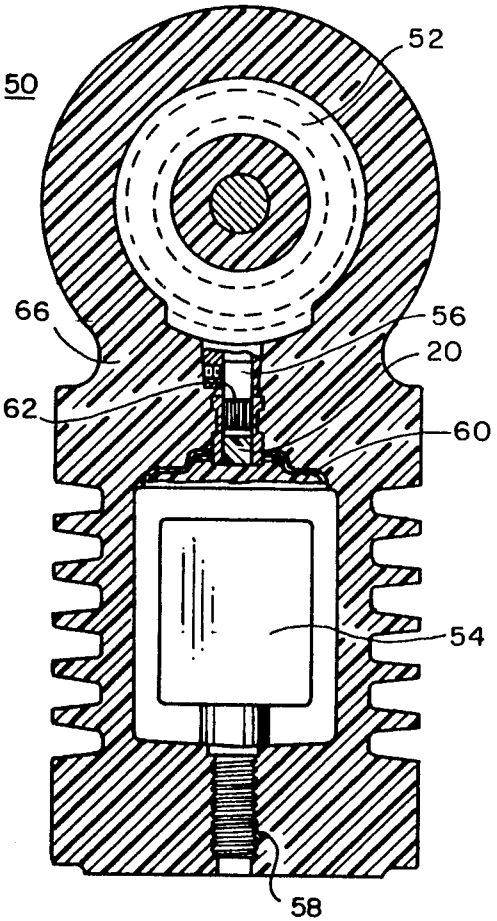
FIG. 10 is a sectional view taken generally along the line 10—10 of FIG. 8.

While there have been illustrated and described various embodiments of the present invention, it will be apparent that various changes and modifications will occur to those skilled in the art. Thus, the present invention encompasses other embodiments to achieve a support arrangement that exhibits the same thermal coefficient of expansion as a molding material. For example, in lieu of or in addition to the support tube 16 being movable within the bore 19, in a specific embodiment, the support tube 16 is fabricated so as to define predetermined resilient and/or flexible characteristics to permit movement of the electrical device with respect to the support base 18. Additionally, as noted in FIG. 12, the support tube 16 may be formed from two interfitting (i.e. telescoping) tubes 16',16'' with a compression member 20'. Of course, as is also true of the embodiment of FIGS. 1-7, the compression member 20' would not be necessary where the tubes 16' and 16'' are not open to the molding material. It should also be realized that the present invention is applicable to any molding process where an elongated or relatively large object is to be encapsulated within the molding material; i.e., where the overall shape factor (volume and length) and/or surface characteristics are such that during molding and curing, the volumetric changes of the molding material relative to the object result in undesirable forces and stresses. Accordingly, it is intended in the appended claims to cover all such changes and modifications that fall within the true spirit and scope of the present invention.

What is claimed and desired to be secured by Letters Patent of the United States is:

1. Apparatus comprising:

an electrical device;

insulating body means having a predetermined volumetric shape and being molded from a predetermined material, said electrical device being disposed within said predetermined material of said insulating body means so as to define an interface with said predetermined material; and means disposed within said predetermined material of said insulating body means and defining an interface with said predetermined material for supporting said electrical device at a predetermined location within said insulating body means and for responding to volumetric changes in said predetermined material, said supporting and responding to volumetric changes being provided by said support means during and after the forming of said insulating body means, said supporting means comprising means for permitting relative movement within and at one or both of said interfaces to said predetermined material of said insulating body means between said electrical device and a predetermined portion of said supporting means.

2. The apparatus of claim 1 wherein said supporting means comprises first means arranged to support said electrical device and second means for supporting said first means and for yielding in response to forces imparted to said second means.

3. The apparatus of claim 2 wherein said second means comprises third means for permitting relative movement between said first means and a first portion of said second means.

4. The apparatus of claim 2 wherein said second means comprises means for yielding under applied forces.

5. The apparatus of claim 4 wherein said second means comprises a support member having first and second spaced-apart portions, said yielding means comprising a member spanning said first and second spaced-apart portions.

6. The apparatus of claim 2 wherein said supporting means further comprises third means for permitting relative movement between said first and said second means.

7. The apparatus of claim 2 wherein said second means further comprises third means for permitting relative movement between said first means and said third means.

8. The apparatus of claim 1 wherein said predetermined material has elevated temperature-curing characteristics.

9. The apparatus of claim 1 wherein said supporting means further comprises means for defining a conduit, said electrical device further including electrical conductors attached thereto and extending through said conduit.

10. The apparatus of claim 9 further comprising electrical terminal means being connected to one or more of said electrical conductors and being located within said insulating body means so as to be accessible at the periphery thereof.

11. The apparatus of claim 9 wherein said supporting means further comprises means for electrically shielding said electrical conductors.

12. The apparatus of claim 1 wherein said supporting means further comprises means for defining a conductive path from a point on the periphery of said insulating body means to said electrical device.

13. The apparatus of claim 1 wherein said supporting means further comprises first means extending to a point communicating with the exterior of said insulating body means.

14. The apparatus of claim 13 wherein said first means comprises fastener receiving means.

15. The apparatus of claim 13 wherein said first means is electrically conductive.

16. The apparatus of claim 1 wherein said supporting means comprises a support tube and first means for yieldingly supporting said support tube.

17. The apparatus of claim 16 wherein said first means comprises a support member having a receiving passage and a compressible member located within said receiving passage, said support tube being positioned into said receiving passage.

18. The apparatus of claim 17 wherein said electrical device includes electrical conductors, said support tube defining a conduit, said electrical conductors being routed through said conduit.

19. The apparatus of claim 17 wherein said receiving passage and said support tube are dimensioned to provide an interference fit.

20. The apparatus of claim 17 wherein said support tube includes an outer knurled portion at a first end that is positioned into said support member.

21. The apparatus of claim 20 wherein said compressible member includes a passage therethrough, said electrical device including electrical conductors that are disposed through said support tube and said compressible member.

22. The apparatus of claim 1 wherein said supporting means comprises two telescoping support tubes.

23. The apparatus of claim 1 wherein said electrical device is a current-sensing transformer having a central opening, said apparatus including a conductor disposed through said central opening and supported by said insulating body means.

24. The apparatus of claim 1 wherein said insulating body means includes a receiving cavity.

25. The apparatus of claim 24 further comprising a transformer being encapsulated within said insulating body means.

26. The apparatus of claim 25 further comprising a capacitor disposed within said receiving cavity, a potting compound surrounding said capacitor and filling said receiving cavity.

27. The apparatus of claim 26 wherein said supporting means comprises said transformer, a support tube, and means for yieldingly mounting said support tube with respect to said transformer, said support tube supporting said electrical device.

28. The apparatus of claim 27 wherein said electrical device is a current-sensing transformer.

29. Apparatus comprising:

an electrical device;

supporting means for positioning and yieldingly supporting said electrical device; and a support housing being molded of a compound that exhibits volumetric changes during molding and curing, each of said electrical device and said supporting means being disposed within said compound during the molding of said support housing so as to define an interface with respect to said compound, said supporting means responding to and accommodating for the effects of forces occurring during the molding and curing of said support housing by permitting relative movement within said compound of said support housing between said electrical device and a first end of said supporting means, said first end being opposite a second end that is adjacent said electrical device.

30. Apparatus comprising:

an electrical device;

supporting means for positioning and movably supporting said electrical device; and a support housing being molded from a molding material, said electrical device and said supporting means being disposed within said molding material during the molding of said support housing such that each of said electrical device and said supporting means define an interface with respect to said molding material, said supporting means accommodating volumetric changes of the molding material and the combination of said electrical device and said supporting means by permitting relative movement between said electrical device and a predetermined portion of said supporting means within said molding material of said support housing in response to forces exerted on said electrical device.

31. Apparatus comprising:

an electrical device;

insulating body means having a predetermined volumetric shape, being molded from a predetermined material and surrounding said electrical device; and means disposed within said insulating body means for supporting said electrical device at a predetermined location within said insulating body means and for responding to volumetric changes in said predetermined material during and after the forming of said insulating body means, said supporting means comprising means for permitting relative movement within said insulating body means between said electrical device and a predetermined portion of said supporting means, said relative-movement-permitting means comprising a support tube and first means for yieldingly supporting said support tube, said first means comprising a support member having a receiving passage and a compressible member located within said receiving passage, said support tube being positioned into said receiving passage.

* * * * *

UNITED STATES PATENT AND TRADEMARK OFFICE

CERTIFICATE OF CORRECTION

PATENT NO. : 5,162,726

DATED : Nov. 10, 1992

INVENTOR(S) : Roy T. Swanson, et al

It is certified that error appears in the above-identified patent and that said Letters Patent is hereby corrected as shown below:

Col. 1, line 18, "198" should be -- TM --.

Signed and Sealed this

Seventh Day of December, 1993

Bruce Lehman

*Attest:*

BRUCE LEHMAN

*Attesting Officer*

*Commissioner of Patents and Trademarks*